US006836641B2

(12) United States Patent
Uchida et al.

(10) Patent No.: US 6,836,641 B2
(45) Date of Patent: Dec. 28, 2004

(54) IMAGE FORMING APPARATUS AND IMAGE FORMING METHOD

(75) Inventors: Michio Uchida, Shizuoka (JP); Yoshiro Tsuchiya, Shizuoka (JP); Kazunori Takashima, Shizuoka (JP); Yoshiro Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/367,750

(22) Filed: Feb. 19, 2003

(65) Prior Publication Data

US 2004/0037601 A1 Feb. 26, 2004

(30) Foreign Application Priority Data

Feb. 18, 2002 (JP) ..... 2002-040021

(51) Int. Cl.[7] ..... G03G 15/00

(52) U.S. Cl. ..... 399/396; 399/401; 101/230; 271/902

(58) Field of Search ..... 101/229, 230, 101/231, 232; 271/291, 902; 399/396, 401, 406

(56) References Cited

U.S. PATENT DOCUMENTS

| | | | | |
|---|---|---|---|---|
| 5,115,281 A | | 5/1992 | Ohtsuka et al. | 355/319 |
| 5,449,162 A | | 9/1995 | Saito et al. | 271/122 |
| 5,508,796 A | | 4/1996 | Sasame et al. | 355/271 |
| 5,523,829 A | | 6/1996 | Miyashiro et al. | 355/271 |
| 5,678,817 A | | 10/1997 | Saito et al. | 271/122 |
| 5,944,305 A | | 8/1999 | Takashima et al. | 271/127 |
| 6,385,428 B1 | | 5/2002 | Uchida et al. | 399/303 |
| 6,681,096 B2 | * | 1/2004 | Seto et al. | 399/388 |

FOREIGN PATENT DOCUMENTS

| | | | |
|---|---|---|---|
| JP | 5-307291 | | 11/1993 |
| JP | 10-161461 | * | 6/1998 |

* cited by examiner

*Primary Examiner*—Ren Yan
(74) *Attorney, Agent, or Firm*—Fitzpatrick, Cella, Harper & Scinto

(57) ABSTRACT

There is provided an image forming apparatus that can suppress the formation of creases when forming images on both surfaces of a sheet and can greatly reduce the incidence of unprinted areas. The image forming apparatus has a sheet stacking section in which sheets are stacked, a sheet conveying section that conveys a sheet, an image forming section that forms an image on the sheet while the sheet is conveyed, a re-conveying section that again conveys the sheet with the image formed on a first surface thereof to the image forming section, and a sheet feeding section that feeds a sheet from the sheet stacking section or the re-conveying section to the image forming section. When a sheet is fed from the sheet stacking section for image formation on the first surface of the sheet by the image forming section, the sheet is fed at a first speed, and when a sheet is fed from the re-conveying section for image formation on a second surface of the sheet by the image forming section, the sheet is fed at a second speed that is slower than the first speed and is slower than the speed at which the sheet is conveyed by the sheet conveying section.

16 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus, such, as a printer or a copier, and to an image forming method that uses an electrophotographic method or an electrostatic recording method.

2. Description of the Related Art

In recent years, image forming apparatuses that use an electrophotographic method have been made with increased speed and performance, and have also progressed in color image forming technology. Printers and copiers that use a variety of methods to form color images have been brought onto the market. For example, a so-called "inline-type" image forming apparatus is known, in which image forming means for a plurality of colors are arranged in a line and toner images that have been formed by each of these image forming means are transferred in order on top of one another onto a sheet (the transfer medium). Image forming apparatuses of the inline type can form color images at high speeds, and so are expected to become the principal type of color printer, in the future. Such inline-type image forming apparatuses are constructed so as to hold and convey a sheet using a belt-shaped conveying means (a sheet conveyor belt) and to transfer toner images of colors on top of one another onto the sheet in order, thereby producing a color image.

In addition, in the inline-type image forming apparatus, the sheet conveyor belt extends in the direction in which image forming stations are arranged and is disposed in contact with each of the image forming stations. To improve the transferring of toner images onto a sheet that is conveyed by the sheet conveyor belt, it is preferable for the sheet to be stably held on the sheet conveyor belt by attraction. For example, by applying an attraction bias (a voltage or current) to the surface of the sheet conveyor belt, a sheet can be stably held on the sheet conveyor belt by attraction.

When forming toner images on both surfaces of a sheet using the inline-type image forming apparatus described above, after the trailing end of a sheet that has had an image formed on a first surface (the front) thereof has passed a fixer that heat-fixes the toner images on the sheet, the conveying direction of the sheet is reversed so that the second surface (the reverse) of the sheet becomes the image forming surface, the sheet is guided to a re-conveying path once again, and the sheet is fed towards the plurality of image forming means for a second time.

When images are formed on both surfaces of a sheet, however, image formation is performed on the second surface of the sheet after the sheet has been heated and subjected to pressure by the fixer, so that there are cases where a peripheral part of the sheet becomes wrinkled. If a sheet in this state is conveyed by the sheet conveyor belt to which an attraction bias has been applied, the wrinkled part of the sheet is strongly held on the sheet conveyor belt by attraction. As a result, as shown in FIGS. 5A and 5B, the wrinkled part)(Sb) of the sheet (S) causes creases to be formed that are directed towards the trailing end of the sheet. Toner images are not transferred to the concave parts of the creases (i.e., the parts where there is no contact between the sheet and the photosensitive drums), so that there are cases where certain areas are left unprinted. It should be noted that concave and convex parts of the creases are depicted in an exaggerated fashion in FIGS. 5A and 5B for the sake of explanation.

Also, when image formation has ended for the first surface (the front), wrinkling occurs in the sheet that has passed the fixer at both sides in the direction that is perpendicular to the conveying direction. The lengths in the conveying direction of the both sides at which such wrinkling occurs will be longer than the length of the central part of the sheet. This means that when image formation is performed on the second surface (the reverse) of the sheet, the wrinkled parts at both sides of the sheet cause creases to be formed concentrated at the trailing end of the sheet. This can result in unprinted areas being left on the sheet at the transfer sections.

SUMMARY OF THE INVENTION

The present invention was devised in view of the above problems with the related art, and it is an object of the present invention to provide an improved image forming apparatus and image forming method.

It is a further object of the present invention to provide an image forming apparatus and image forming method that can suppress the formation of creases when forming images on both surfaces of a sheet and can greatly reduce the incidence of unprinted areas.

To attain the above objects, in a first aspect of the present invention, there is provided an image forming apparatus comprising a sheet stacking section in which sheets are stacked each having a first surface and a second surface, a sheet conveying section that conveys the sheets, an image forming section that forms an image on a sheet while the sheet is conveyed by the sheet conveying section, a re-conveying section that again conveys the sheet having an image formed on the first surface thereof to the image forming section, a sheet feeding section that feeds a sheet from the sheet stacking section or the re-conveying section to the sheet conveying section, wherein the sheet is conveyed while it is held between the sheet conveying section and the sheet feeding section, and a controller that controls a feeding speed of the sheet fed by the sheet feeding section, wherein the controller controls the feeding speed of the sheet in a manner such that the sheet is fed at a first speed when the sheet is fed from the sheet stacking section to form an image on the first surface of the sheet, and the sheet is fed at a second speed lower than the first speed and lower than a speed at which the sheet is conveyed by the sheet conveying section when the sheet is fed from the re-conveying section to form an image on the second surface of the sheet.

Preferably, the first speed is approximately equal to the speed at which the sheet is conveyed by the sheet conveying section.

Preferably, the image forming apparatus according to another aspect of the invention further comprises an operation mode setting section that sets an operation mode of the image forming apparatus, wherein the controller is responsive to setting of a first operation mode by the operation mode setting section, for causing the sheet from the re-conveying section to be fed at the first speed, and is responsive to setting of a second operation mode by the operation mode setting section, for causing the sheet from the re-conveying section to be fed at the second speed.

Preferably, the operation mode setting section sets the operation mode based on information relating to the type of sheet.

In a preferred form of the present invention, the image forming apparatus further comprises a detection section that detects a resistance of the sheet, and wherein the operation mode setting section sets the first operation mode when the resistance of the sheet is higher than a predetermined value and sets the second operation mode when the resistance of the sheet is equal to or lower than the predetermined value.

In another preferred form of the present invention, the image forming apparatus further comprises a detection section that detects humidity, and wherein the operation mode setting section sets the first operation mode when the humidity is equal to or lower than a predetermined value and sets the second operation mode when the humidity is higher than the predetermined value.

Preferably, the image forming section comprises an image carrier that transfers a toner image onto the sheet, and a fixing section that fixes the toner image onto the sheet.

In a specific form of the present invention, the fixing section comprises a pair of rollers that rotate while they are in contact with one another and fix the toner image onto the sheet by heating and applying pressure to the sheet.

Preferably, the sheet conveying section comprises a belt-shaped conveying member that conveys the sheet, and the image forming apparatus comprises a bias applying section that applies a bias to the belt-shaped conveying member to hold the sheet on the belt-shaped conveying member by attraction.

Also preferably, the sheet conveying section comprises a belt-shaped conveying member that conveys the sheet, and the image forming section comprises a plurality of image carriers that are arranged in a conveying direction of the sheet, for forming toner images of different colors on the sheet that is conveyed by the belt-shaped conveying member.

More preferably, the image forming apparatus comprises a bias applying section that applies a bias to the belt-shaped conveying member to hold the sheet on the belt-shaped conveying member by attraction.

To attain the above objects, in a second aspect of the present invention, there is further provided an image forming method of forming an image on both surfaces of a sheet, comprising a supplying step of supplying a sheet from a sheet stacking section in which sheets are stacked each having a first surface and a second surface, a first feeding step of feeding the sheet supplied in the supplying step at a first speed, a first conveying step of conveying the sheet fed in the first feeding step, starting from before feeding of the sheet in the first feeding step is completed, a first image forming step of forming an image on the first surface of the sheet while the sheet is conveyed by the first conveying step, a re-conveying step of re-conveying the sheet having the image formed on the first surface in the first image forming step, in order for an image to be formed on the second surface of the sheet, a second feeding step of feeding the sheet re-conveyed in the re-conveying step, at a second speed that is slower than the first speed and is slower than a speed at which the sheet is conveyed in the first conveying step, a second conveying step of conveying the sheet fed in the second feeding step, starting from before feeding of the sheet in the second feeding step is completed, and a second image forming step of forming an image on the second surface of the sheet while the sheet is conveyed in the second conveying step.

Preferably, the first speed is approximately equal to a speed at which the sheet is conveyed in the first conveying step and the second conveying step.

Also preferably, the first image forming step and the second image forming step each comprise a transfer step of transferring a toner image onto the sheet, and a fixing step of fixing the toner image on the sheet.

More preferably, the first image forming step and the second image forming step each include a plurality of the transfer steps of transferring toner images of different colors onto the sheet.

Preferably, the first image forming step includes a first bias applying step of applying applying a bias for holding the sheet on the belt-shaped conveying member by attraction in the first conveying step, and the second image forming step includes a second bias applying step of applying a bias for holding the sheet on the belt-shaped conveying member by attraction in the second conveying step.

To attain the above objects, in a third aspect of the present invention, there is provided an image forming apparatus comprising a sheet stacking section in which sheets are stacked, a section that has a belt-shaped sheet conveying member that conveys the sheets, an image forming section that forms an image on a sheet while the sheet is conveyed by the sheet conveying section, a re-conveying section that again conveys the sheet having an image formed on the first surface thereof by the image forming section to the image forming section, wherein the sheet is conveyed while it is the sheet conveying section and the sheet feeding section, an attraction section that holds the sheet on the conveying member by a predetermined attraction force, a controller that controls the image forming apparatus, and wherein the controller provides control such that the predetermined attraction force is set to a smaller value when the sheet is fed from the sheet stacking section to form an image on the second surface of the sheet than a value when the sheet is fed from the re-conveying section to form an image on the second surface of the sheet.

Preferably, the attraction section applies a bias to the sheet to hold the sheet on the conveying member by attraction, and wherein the controller provides control such that the bias is set to a smaller value when the sheet is fed from the sheet stacking section to form an image on the second surface of the sheet than a value when the sheet is fed from the re-conveying section to form an image on the second surface of the sheet.

The above and other objects, features and advantages of the invention will become more apparent from the following detailed description taken in conjunction with the accompanying drawings.

DETAILED DESCRIPTION OF THE PREFERRED EMBODIMENTS

The present invention will now be described with reference to the accompanying drawings showing a preferred embodiment thereof.

Figure 1:
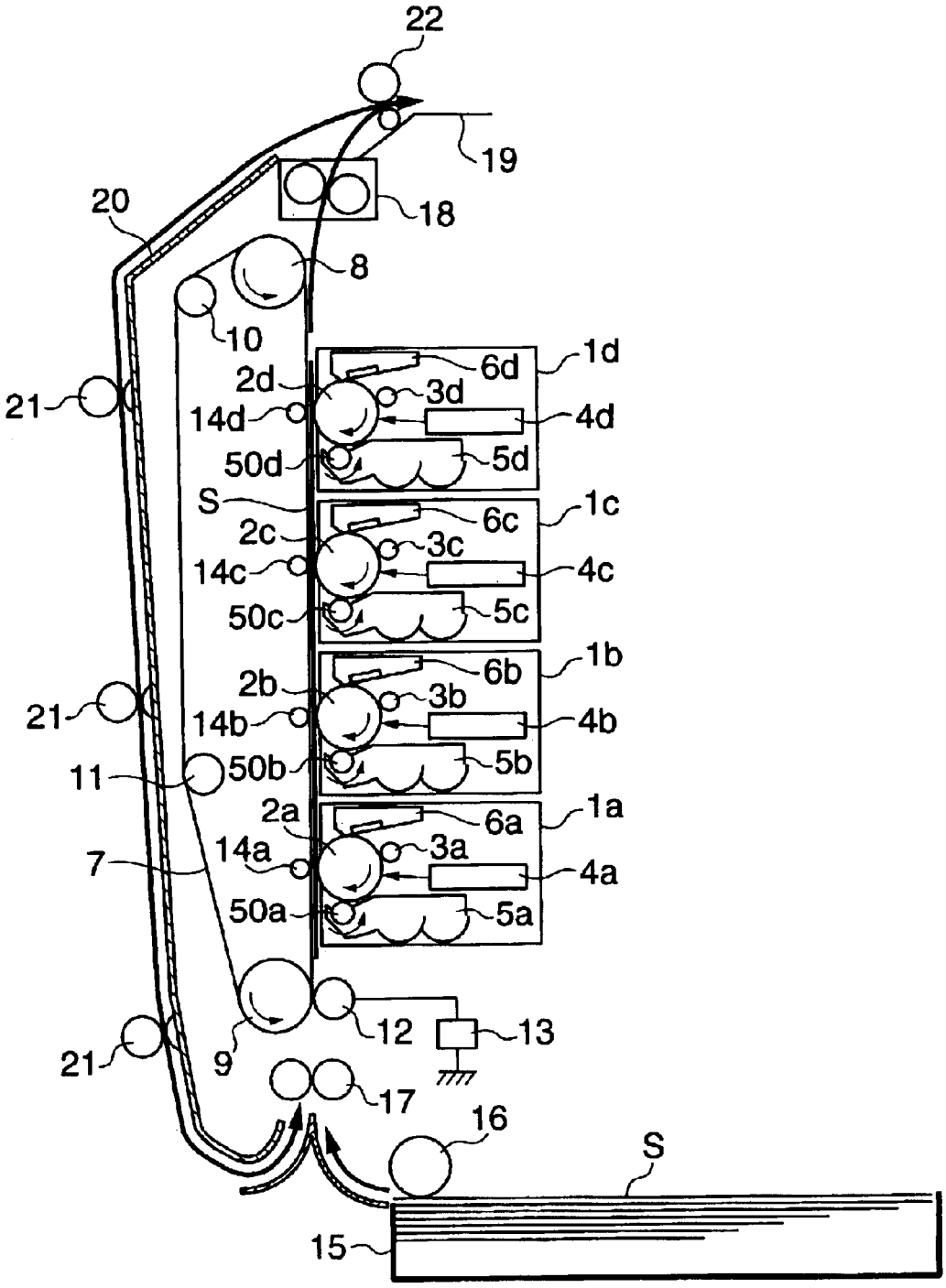
FIG. 1 is a sectional view showing the overall construction of an image forming apparatus according to an embodiment of the present invention.
Figure 2:
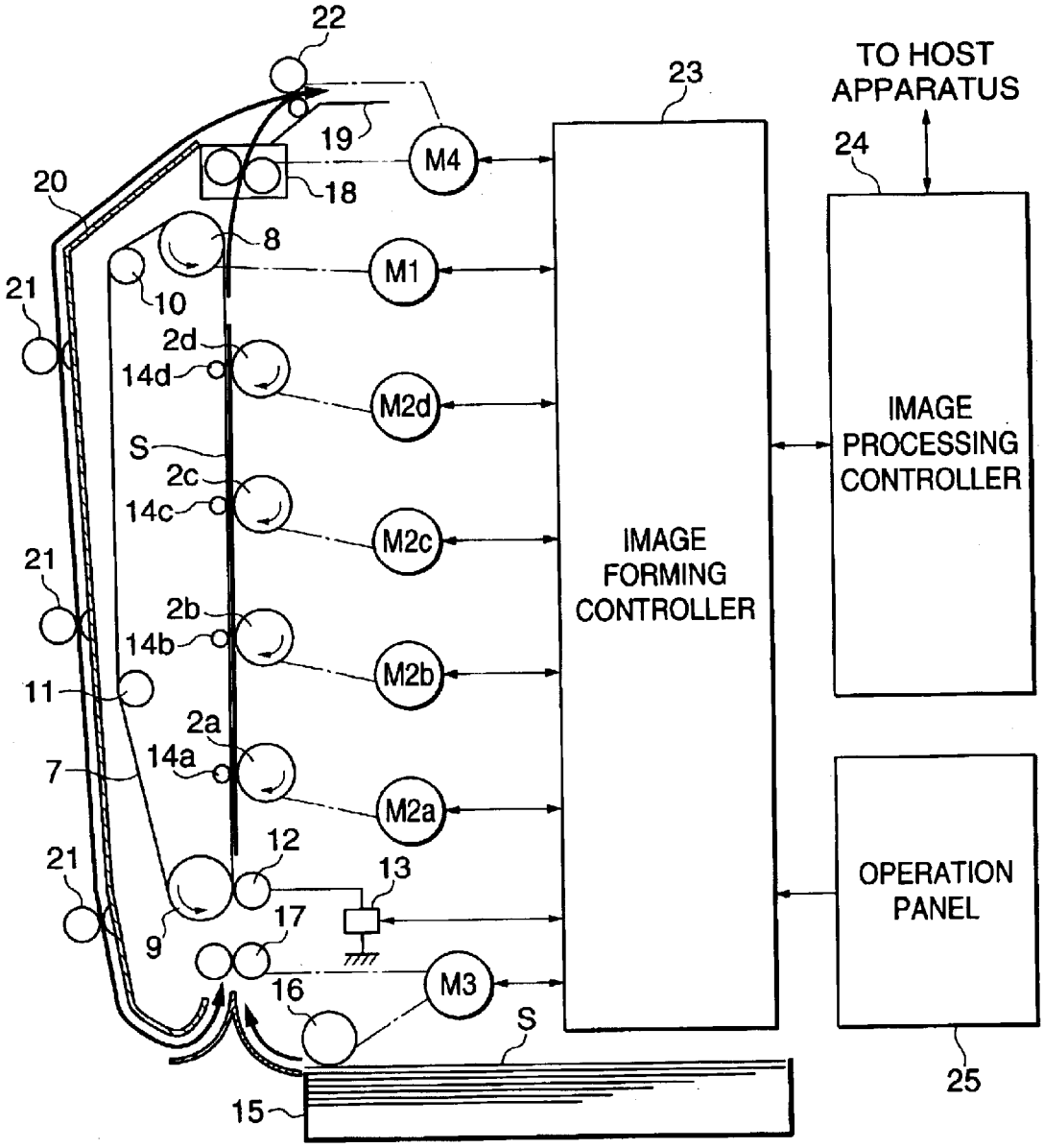
FIG. 2 is a diagram showing the construction of a control system of the image forming apparatus.
Figure 3:
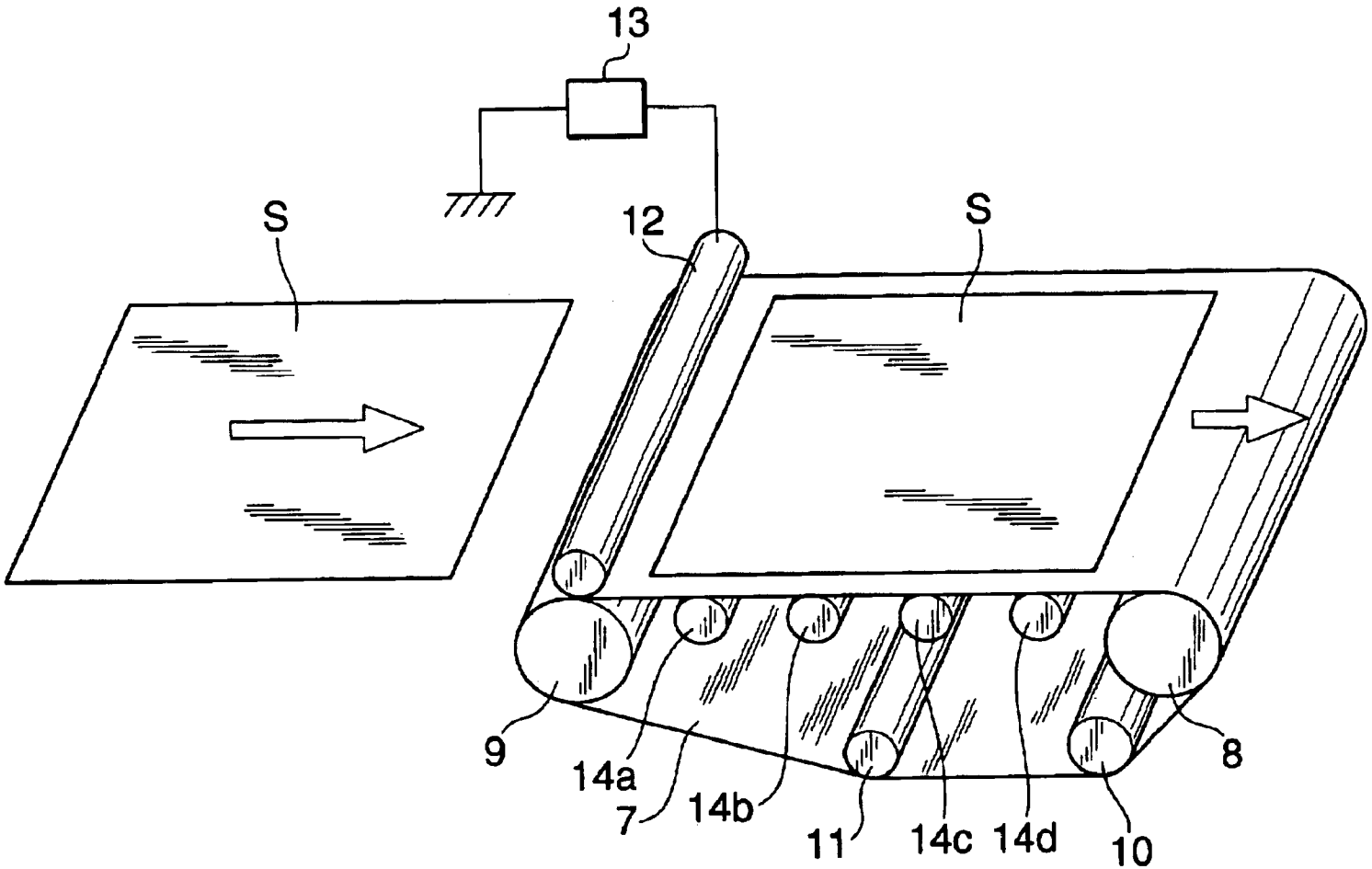
FIG. 3 is a view showing the conveying state of a sheet when image formation is performed on a first surface of the sheet.

FIG. 1 is a view showing the overall construction of an image forming apparatus according to an embodiment of the present invention, FIG. 2 is a diagram showing the construction of a control system of the image forming apparatus, and FIG. 3 is a view showing the conveying state of a sheet when image formation is performed on a first surface of the sheet.

The image forming apparatus according to the present embodiment is a full-color image forming apparatus that uses an electrophotographic method, and as shown in FIG. 1, is comprised of four image forming stations 1*a* to 1*d*, and a sheet conveyor belt 7. The image forming stations 1*a* to 1*d* are arranged substantially in a straight line extending in a vertical direction and each form an image of a different color. The sheet conveyor belt 7 conveys a sheet S.

The image forming stations 1*a* to 1*d* respectively include photosensitive drums 2*a* to 2*d* that carry at least latent images. Charging rollers 3*a* to 3*d*, exposers 4*a* to 4*d*, developing units 5*a* to 5*d*, and cleaning devices 6*a* to 6*d* are respectively arranged around the photosensitive drums 2*a* to 2*d*. The charging rollers 3*a* to 3*d* charge the photosensitive drums 2*a* to 2*d* to an equal potential. The exposers 4*a* to 4*d* emit laser light onto the photosensitive drums 2*a* to 2*d* that have been evenly charged by the charging rollers 3*a* to 3*d* to form electrostatic latent images. The developing units 5*a* to 5*d* develop the latent images formed on the photosensitive drums 2*a* to 2*d* using toners of the corresponding colors (magenta, cyan, yellow, and black) to form visible images. The cleaning devices 6*a* to 6*d* remove any toner remaining on the photosensitive drums 2*a* to 2*d*.

The developing units 5*a* to 5*d* include developing sleeves 50*a* to 50*d* that hold the toner. Each of these developing sleeves 50*a* to 50*d* is supported at a predetermined distance from a corresponding one of the photosensitive drums 2*a* to 2*d* or in pressure contact with the corresponding photosensitive drum under a predetermined pressure. During development, a developing bias is applied between the photosensitive drums 2*a* to 2*d* and the developing sleeves 50*a* to 50*d*.

The sheet conveyor belt 7 carries and conveys the sheet S in the direction in which the image forming stations 1*a* to 1*d* are arranged. The sheet conveyor belt 7 is engaged on a driving roller 8, a follower roller 9, and belt supporting rollers 10, 11, and is rotatively driven in the direction shown by the arrow in FIG. 1. While conveying the sheet S, the sheet conveyor belt 7 brings the sheet S into contact with the photosensitive drums 2*a* to 2*d* of the image forming stations 1*a* to 1*d* in that order.

In order to rotate the sheet conveyor belt 7, the driving roller 8 is driven by a sheet conveyor belt driving motor M1 in the direction shown by the arrow in FIG. 1. The follower roller 9 and the belt supporting rollers 10, 11 rotate in accordance with the rotation of the sheet conveyor belt 7. The photosensitive drums 2*a* to 2*d* are independently rotated by drum motors M2*a* to M2*d*.

An attraction roller 12 that is disposed opposite the follower roller 9 contacts the surface of the sheet conveyor belt 7 at a location upstream of the image forming station 1*a* in the transfer medium conveying direction. This attraction roller 12 presses the sheet S against the sheet conveyor belt 7 as the sheet S passes the attraction roller 12 such that the sheet S is sandwiched therebetween. A fixed current bias is applied to the attraction roller 12 by a fixed current power supply (bias unit) 13, so that the sheet S that passes the attraction roller 12 is electrically charged, resulting in the sheet S being held on the sheet conveyor belt 7 by attraction.

Transfer rollers 14*a* to 14*d* are disposed on the inside of the sheet conveyor belt 7 at locations that are respectively opposite the photosensitive drums 2*a* to 2*d*. These transfer rollers 14*a* to 14*d* press onto the corresponding photosensitive drums 2*a* to 2*d* via the sheet conveyor belt 7. A transfer bias is applied to each of the transfer rollers 14*a* to 14*d*, so that the toner images of colors on the photosensitive drums 2*a* to 2*d* are transferred onto the sheet S.

Sheets S are stacked in a supply cassette 15 that is provided in a lower part of the apparatus. A supply roller 16 separates and supplies one sheet at a time from the supply cassette 15, and feeds the sheet to the pair of resist rollers 17. The pair of resist rollers 17 feeds the sheet S between the sheet conveyor belt 7 and the attraction roller 12, in synchronism with the image formation by the photosensitive drums 2*a* to 2*d*. The sheet S is electrically charged by the attraction roller 12 and conveyed along the image forming stations 1*a* to 1*d* in a state where the sheet S is held on the sheet conveyor belt 7 by attraction.

The supply roller 16 and the pair of resist rollers 17 are rotatively driven by a driving force supplied by a feed motor M3 and feed the sheet S in the direction shown by the arrow in FIG. 1. It is possible for the pair of resist rollers 17 to convey the sheet S together with the sheet conveyor belt 7 located opposite the attraction roller 12. That is, the size of the sheet S that is conveyed by the image forming apparatus is larger than the distance between the pair of resist rollers 17 and the attraction roller 12. The sheet S is conveyed by the sheet conveyor belt 7 located opposite the attraction roller 12 and the pair of resist rollers 17 while being held between the belt 7 and the roller 12.

Toner images on the photosensitive drums 2*a* to 2*d* are transferred in order one on top of the other onto the sheet S that is conveyed via the image forming stations 1*a* to 1*d* by the sheet conveyor belt 7, and the sheet S onto which the toner images have been transferred is sent to a fixer 18. The fixer 18 heats and applies pressure to the sheet S, and by fixing the toner images on the sheet S, an image is formed on the sheet S. After this, the sheet S is conveyed by the fixer 18 and a discharge roller 22 and is then discharged into a discharge tray 19 outside the apparatus.

When images are formed on both surfaces of the sheet S, image formation on the first surface (the front) of the sheet S is complete when the trailing end of the sheet S has passed through the fixer 18, and after the trailing end of the sheet S has passed the fixer 18, the conveying direction of the sheet S is reversed by the discharge roller 22, so that the sheet S is guided to a re-conveying path 20. The sheet S that has been guided to the re-conveying path 20 is conveyed by a plurality of re-conveying rollers 21 and is fed back to the pair of resist rollers 17. After this, an image is formed on the second surface (the reverse) of the sheet S by the same procedure as for the first surface, and the sheet S is discharged to the discharge tray 19.

A driving force is applied to the fixer 18 and the discharge roller 22 by a fixing motor M4. The sheet S can be discharged to the discharge tray 19 by having the fixing motor M4 rotate forwards and the sheet S that has been discharged from the fixer 18 can be guided to the re-conveying path 20 by the discharge roller 22 by having the fixing motor M4 rotate in reverse. The fixer 18 has a pair of rollers which are disposed in urging contact with each other under a predetermined pressure. One of the pair of rollers is rotatively driven by the fixing motor M4, and the other rotates in a manner following the one roller. The sheet S is conveyed toward the discharge roller 22 by the pair of rollers while being held between the pair of rollers. While no motor is shown as rotating the re-conveying rollers 21 in FIG. 2, a construction where the sheet conveyor belt driving motor M1, for example, applies a driving force may be used.

While the overall construction of the image forming apparatus has been described above, the sheet conveyor belt driving motor M1, the drum motors M2*a* to M2*d*, the feed motor M3, and the fixing motor M4 that are used to convey the sheet S are controlled by an image forming controller 23 shown in FIG. 2, with it being possible to control each of the motors independently. The image forming controller 23 is connected to an image processing controller 24 that receives commands and image data from a host apparatus on the outside of the image forming apparatus and processes the commands and image data. The image forming controller 23 receives information relating to the size and type of the sheet, a print mode such as color or monochrome, from the host apparatus via the image processing controller 24, sets an operation mode based on the received information, and can control the conveying speed of the sheet based on the set operation mode. For example, if the conveying speed used when the sheet type is plain paper is set at 1, control can be performed to set ½ speed for an OHT (Overhead Transparency) and ⅓ speed for glossy paper with a high luster. It may be constructed such that a sensor that determines the type of sheet is provided inside the image forming apparatus, with the conveying speed of the sheet mentioned above being controlled based on a detection result of this sensor.

The image forming controller 23 is adapted to control the image forming operation in addition to such control of the motors. That is, the image forming controller 23 performs control of the fixed current power supply 13 that applies the fixed current bias to the attraction roller 12, control of the voltages applied to the charging rollers 3*a* to 3*d*, control of the emission of laser light by the exposers 4*a* to 4*d*, and control of the developing biases applied to the developing sleeves 50*a* to 50*d*.

In the image forming apparatus with the overall construction and control system construction described above, the problems that can occur when forming images on both surfaces of the sheet S are as follows.

In cases where images are formed on both surfaces of the sheet S, when an image is formed on the first surface (the front), a sheet in the supply cassette 15 on which no images have been formed is fed, so that the peripheral part of the sheet S is not wrinkled or otherwise deformed. When an attraction bias is applied to the sheet S, the entire surface of the sheet S is evenly held onto the sheet conveyor belt 7 by attraction, so that if the sheet is conveyed while in contact with the photosensitive drums 2*a* to 2*d*, hardly any creases are formed in the sheet S during conveying (see FIG. 3).

Figure 4:
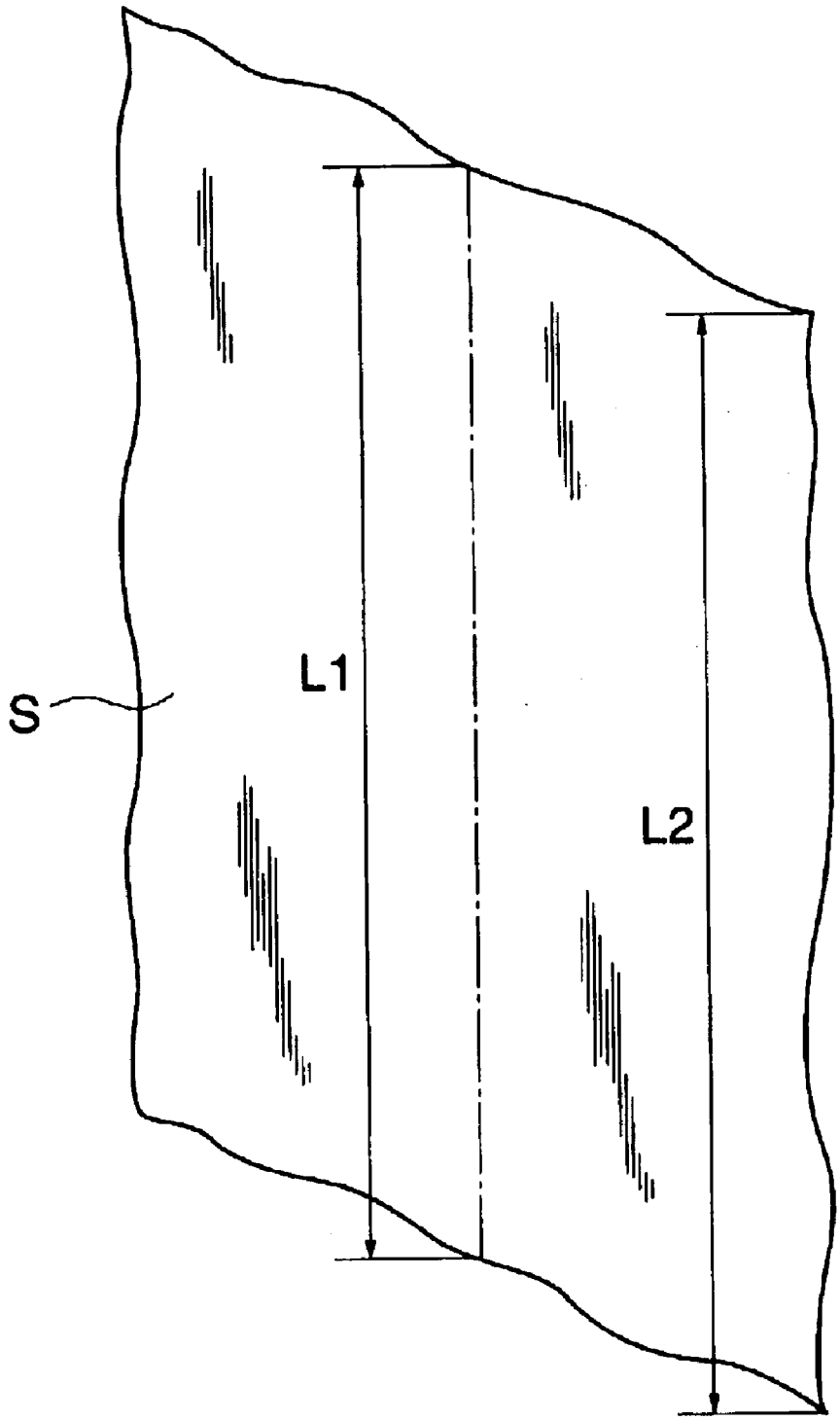
FIG. 4 is a view showing the length in the conveying direction of a sheet with image formation has been performed on the first surface.

On the other hand, when an image is formed on the second surface (the reverse), a sheet that has had an image formed on the first surface (the front) is refed, so that in many cases the peripheral part of the sheet S is wrinkled or otherwise deformed (see FIG. 4). Such wrinkling or other deformation is due to the influence of the heat and pressure applied when the sheet S passes the fixer 18. Wrinkles are present at both sides of the sheet S as shown in FIG. 4, so that the length of the sheet S in the conveying direction is such that the length L1 of the sheet in the central part differs from the length L2 at the sides, with L2 being longer than L1. When the sheet in such state is conveyed between the attraction roller 12 and the follower roller 9 while the attraction bias is being applied, the sheet is conveyed with the leading end of the sheet S strongly held on the sheet conveyor belt 7 by attraction. Since the length L2 at the sides differs from the length L1 in the central part, as the sheet S passes a location where the attraction roller 12 and the follower roller 9 face one another, the part of the sheet corresponding to the difference between L1 and L2 is pushed towards a central part of the trailing end of the sheet S, leading to the formation of creases. This can result in parts of the trailing end of the sheet S becoming unable to closely contact the sheet conveyor belt 7.

Figure 5A:
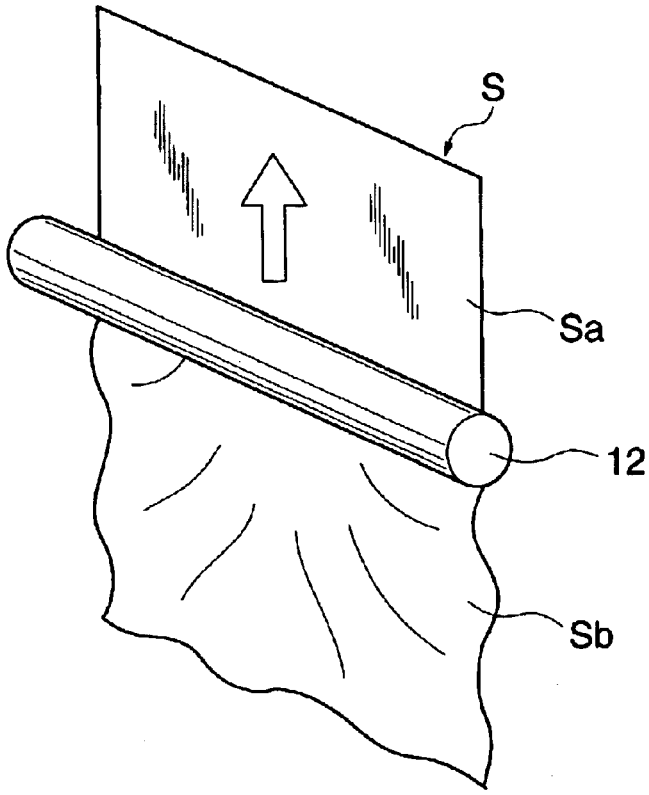
FIGS. 5A and 5B are views showing the state of the sheet S as the sheet passes an attraction roller 12.
Figure 5B:
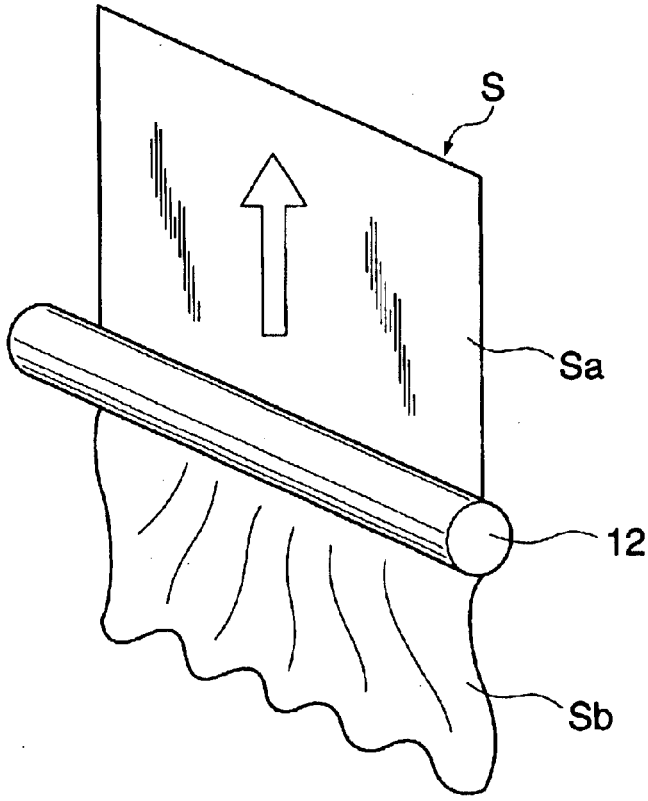
Figure 6:
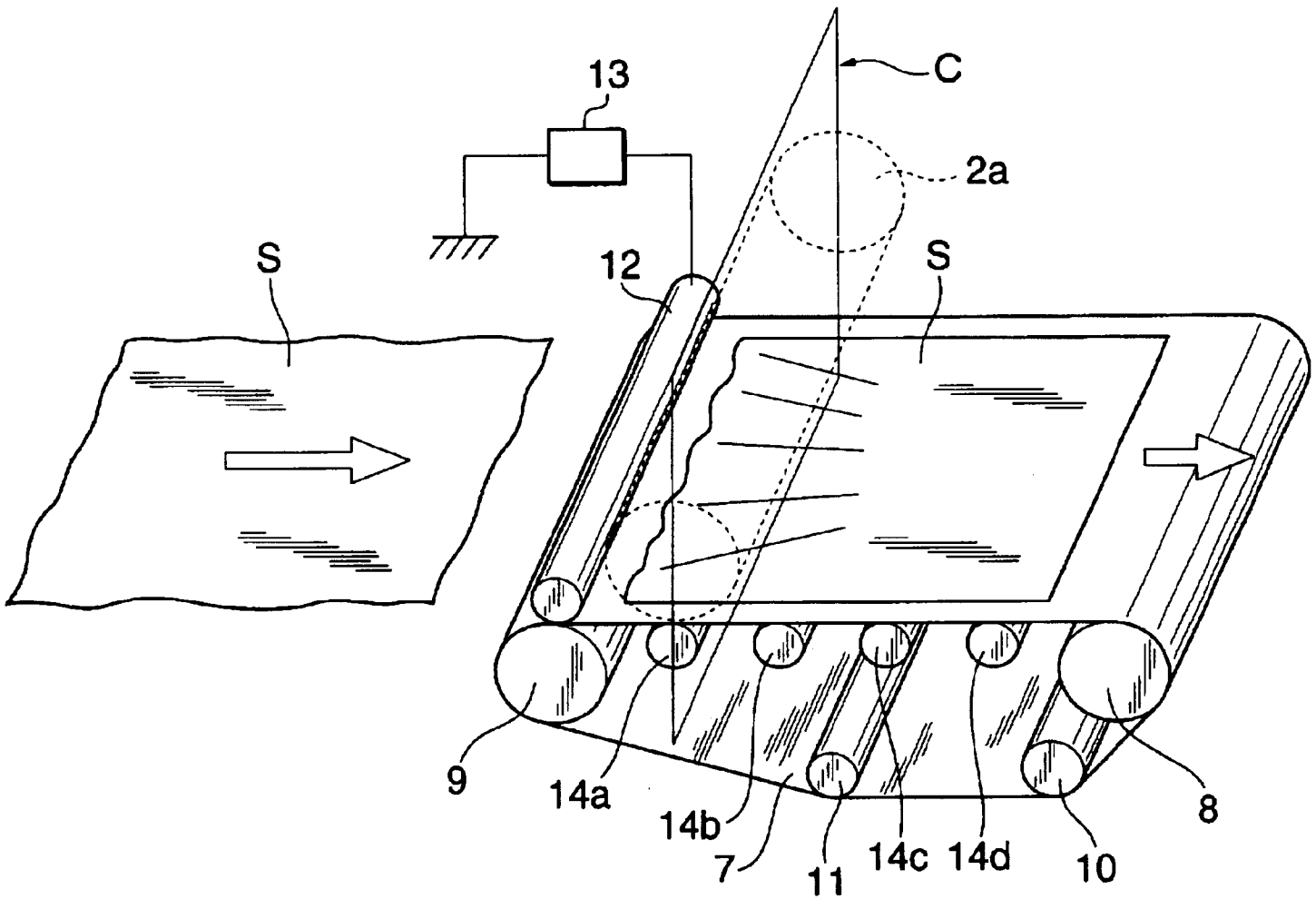
FIG. 6 is a view showing the formation of creases at a trailing end of the sheet when image formation is performed on a second surface of the sheet.

This state is shown in FIGS. 5A, 5B, and 6. It should be noted that concave and convex parts of the creases are depicted to be exaggerated in FIGS. 5A and 5B for the sake of explanation, as mentioned above.

FIGS. 5A and 5B show the state of the sheet S as the sheet S passes the attraction roller 12. The part marked Sa in the figures shows a part of the sheet S that has passed the attraction roller 12 and is held on the sheet conveyor belt 7 by attraction, while the part marked Sb shows another part of the sheet S that is yet to pass the attraction roller 12.

An attraction bias is applied to the sheet S by the attraction roller 12, so that when the sheet S passes the attraction roller 12, the wrinkled part is extended, resulting in a state (Sa) where the sheet S is tightly held on the sheet conveyor belt 7 by attraction. However, for a sheet S that has had an image formed on the first surface (the front), as shown in FIG. 4, the length L2 of the sides is greater than the length L1 of the central part, so that the stretched out wrinkled part gathers in the part Sb that is yet to pass the attraction roller 12. Next, as the sheet S passes the attraction roller 12, the part Sb becomes shorter (see FIG. 5B), but since the wrinkled part that is the difference between the length L1 in the central part of the sheet and the length L2 at the sides gathers, creases appear in the central part of the sheet S as the sheet S passes the attraction roller 12 (as the state changes from that shown in FIG. 5A to that shown in FIG. 5B). When these creases are large, the creases are not stretched out when the sheet S passes the attraction roller 12, so that the sheet S passes the attraction roller 12 with the creases intact, resulting in the sheet S in which creases are formed being conveyed on the sheet conveyor belt 7. This state is shown in FIG. 6. A cross-sectional view showing a cross-section on the plane C shown in FIG. 6 as viewed from the direction shown by the arrow in FIG. 6 is given in FIG. 7.

Figure 7:
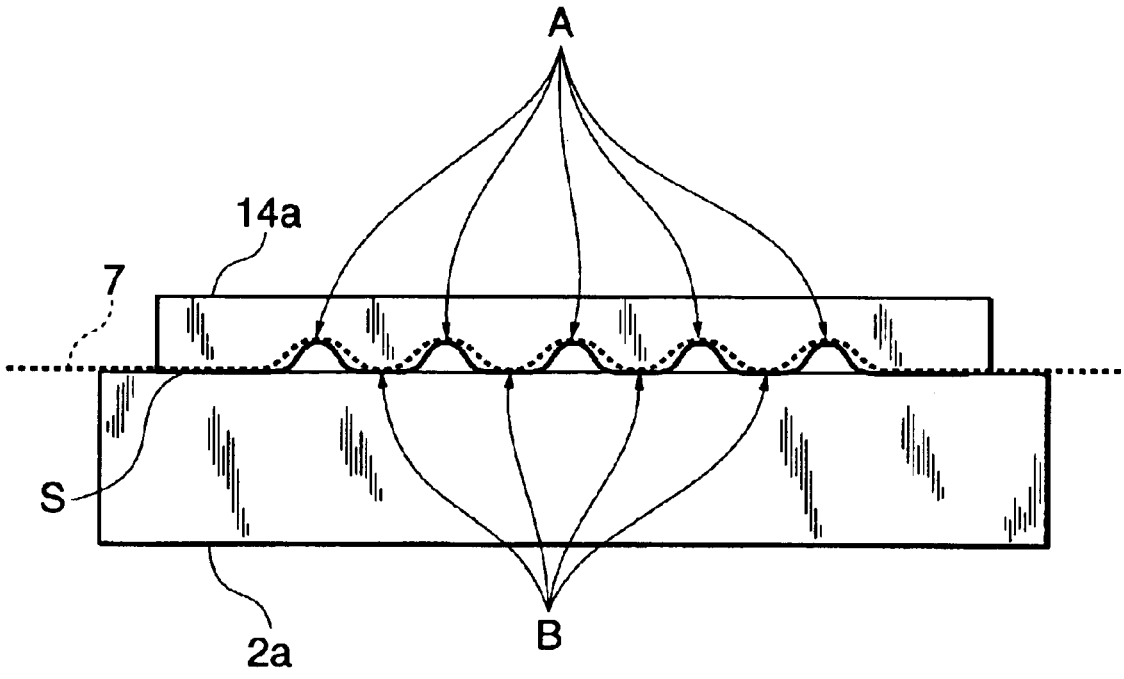
FIG. 7 is a sectional view showing the relationship between undulations in the sheet a photosensitive drum, and the sheet conveyor belt.

As shown in FIG. 7, when creases are formed in the trailing end of the sheet S, the concave part A of the creases facing the photosensitive drum 2*a* does not come into close contact with the photosensitive drum 2*a*, unlike the convex parts B. An attraction bias is applied to the sheet S by the attraction roller 12, so that the concave parts A of the creases are held against the sheet conveyor belt 7 by attraction. This means that once the creases have been formed, the undulations of the creases will remain even after the sheet S has passed through the location where the attraction roller 12 and the follower roller 9 face one another and the sheet S will be conveyed towards the photosensitive drums 2*a* to 2*d* in the creased state. Accordingly, it is difficult for toner images to be transferred to the concave parts A that do not come into close contact with the photosensitive drums 2*a* to 2*d*. Images are not properly transferred onto the sheet S, resulting in the appearance of unprinted parts.

The above problem is caused by the sheet S that has had an image formed on the first surface (the front) being wrinkled or otherwise deformed when an image is formed on the second surface. This problem can be solved by largely eliminating any deformation in the sheet S when forming an image on the second surface of the sheet S.

In the present embodiment, during image formation on the first surface and the second surface of the sheet S, the conveying speed ( ) of the sheet conveyor belt 7 is kept constant. When image formation is performed on the first surface of a sheet S supplied from the supply cassette 15, the feeding speed of the pair of resist rollers 17 is set equal to the conveying speed of the sheet conveyor belt 7. When image formation is performed on the second surface of a sheet S that has been fed via the re-conveying path 20, the feeding speed of the pair of resist rollers 17 is set slower than the conveying speed of the sheet conveyor belt 7. This is, control is performed so that the feeding speed of the pair of resist rollers 17 during image formation on the second surface of the sheet S is slower than the feeding speed of the pair of resist rollers 17 during image formation on the first surface of the sheet S.

When the feeding speed of the pair of resist rollers 17 and conveying speed of the sheet conveyor belt 7 are approximately equal, the trailing end of the sheet S is not stretched by the pair of resist rollers 17 as the sheet S passes the attraction roller 12, so that the part Sa of the sheet S that has passed the attraction roller 12 is tightly held onto the sheet conveyor belt 7 and the wrinkled part of the sheet S gathers in the part (Sb) that is yet to pass the attraction roller 12.

Figure 8:
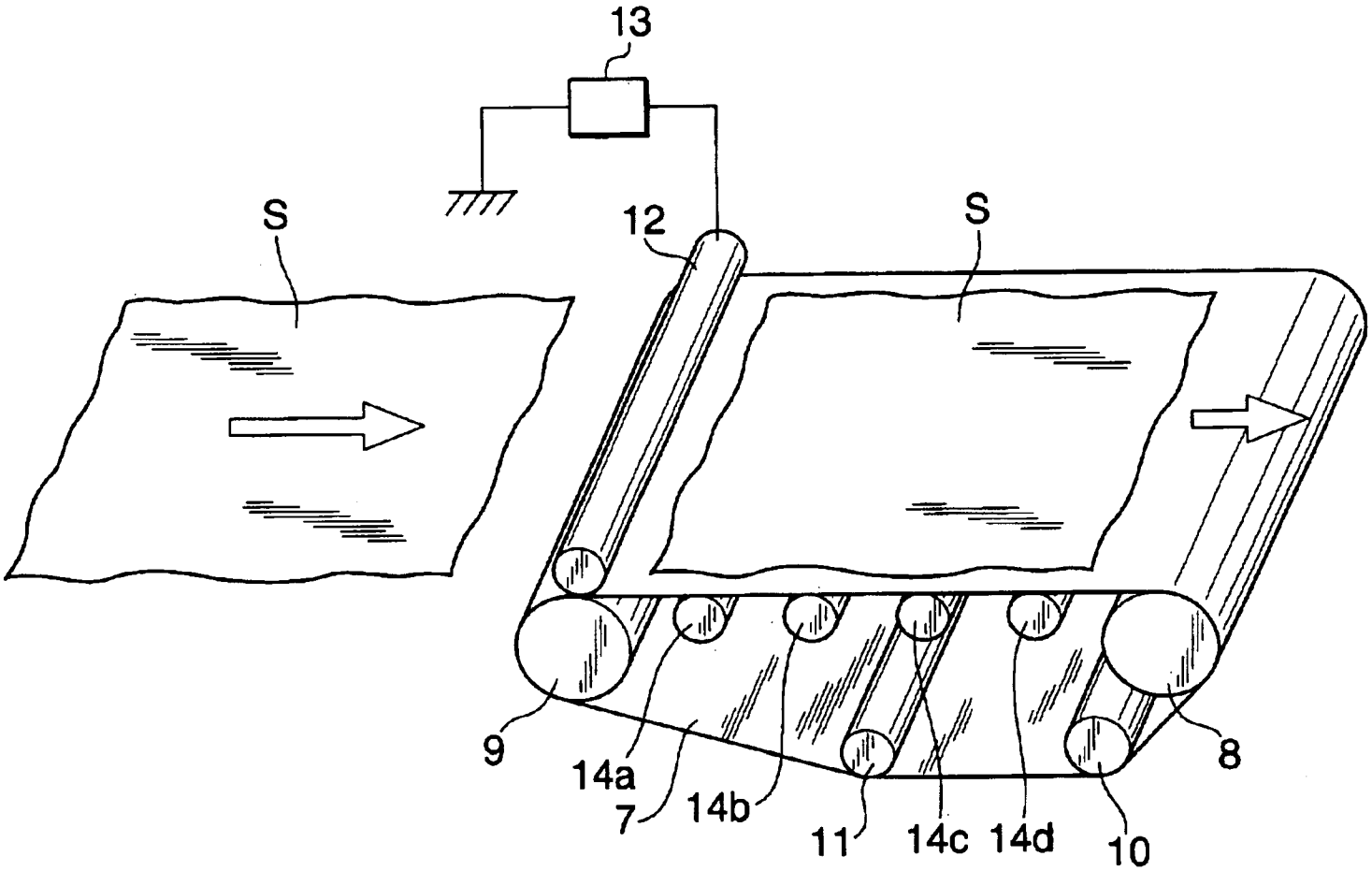
FIG. 8 is a view showing the conveying state of the sheet during image formation on the second surface of the sheet.

On the other hand, if the feeding speed of the pair of resist rollers 17 is set slower than the conveying speed of the sheet conveyor belt 7 only when image formation is being performed on the second surface of the sheet S, the sheet S is stretched between the pair of resist rollers 17 and the part where the attraction roller 12 and the follower roller 9 face one another. At this time, as described earlier the length of the sheet S in the conveying direction is shorter at both sides than in the central part, so that it is mainly the central part that is stretched, with little tension being applied to the both sides. This means that there is a disparity in the fed amount of the sheet S between the central part of the sheet S and the both sides. This is, compared to the central part of the sheet S, a larger amount is fed at the both sides of the sheet S. Accordingly, the wrinkles in the sheet S do not gather at the trailing end and are instead evenly dispersed over the sheet conveyor belt 7, so that no creases are formed and the creation of unprinted areas can be avoided. FIG. 8 shows this state, with the wrinkles not gathering at the trailing end of the sheet S even after the sheet S has passed the attraction roller 12 and instead being evenly dispersed, so that no creases are formed.

Here, when the difference between the feeding speed of the pair of resist rollers 17 and the conveying speed of the sheet conveyor belt 7 is large, slippage of the sheet S on the sheet conveyor belt 7 occurs, which can have a detrimental effect on color alignment. For this reason, the feeding speed of the pair of resist rollers 17 should preferably be around 0.2% slower than the conveying speed of the sheet conveyor belt 7, for example.

When image formation is performed on the first surface of the sheet S, in the sheet S on the sheet conveyor belt 7, there is no difference in the length between the central part and both sides that can cause creases to be formed. This means that if a difference in speed is provided between the conveying speed of the sheet conveyor belt 7 (the conveying speed of the part where the attraction roller 12 and the follower roller 9 face one another) and the feeding speed of the pair of resist rollers 17, the entire sheet S is strongly stretched, which makes it easy for color misalignments to occur. In addition, when the entire sheet S is stretched, vertical wrinkling occurs, which can lead to creases being formed. Therefore, when image formation is performed on the first surface of the sheet S, the conveying speed of the sheet conveyor belt 7 and feeding speed of the pair of resist rollers 17 are set approximately equal.

In this way, in the present embodiment, the conveying speed (process speed) of the sheet conveyor belt 7 is kept constant during image formation on the first surface and the second surface of the sheet S. When image formation is performed on the first surface of a sheet S supplied from the supply cassette 15, the feeding speed of the pair of resist rollers 17 is set equal to the conveying speed of the sheet conveyor belt 7, while when image formation is performed on the second surface of the sheet S that has been fed via the re-conveying path 20, the feeding speed of the pair of resist rollers 17 is set slower than the conveying speed of the sheet conveyor belt 7. As a result, during image formation on the second surface of the sheet S, the wrinkles in the sheet S do not gather at the trailing end and instead are evenly dispersed on the sheet conveyor belt 7, so that creases are not formed and the creation of unprinted areas can be prevented.

Although in this image forming apparatus with the attraction roller 12 and the sheet conveyor belt 7 that convey the sheet, as described above the formation of creases is prevented by providing a difference in speed between the conveying speed of the sheet conveyor belt 7 (the conveying speed of the part where the attraction roller 12 and the follower roller 9 face one another) and the feeding speed of the pair of resist rollers 17 that feed the sheet S to the sheet conveyor belt 7, this technique may be applied in other ways. For example, as the sheet S can be stretched between the pair of resist rollers 17 and the part where the photosensitive drum 2*a* faces the sheet conveyor belt 7, it is possible to provide, even in a construction where no attraction roller 12 is provided, a difference in speed between the conveying speed of the sheet conveyor belt 7 and the feeding speed of the pair of resist rollers 17 that feed the sheet S to the sheet conveyor belt 7. This prevents creases from being formed and hence stops unprinted areas from being produced.

In the above described example, in forming an image on the second surface of the sheet S, the feeding speed of the pair of resist rollers 17 is set lower than the conveying speed of the sheet conveyor belt 7 so as to convey the sheet S with a reduced degree of attraction without allowing the sheet to be strongly held on the sheet conveyor belt 7 by attraction. In addition to this speed control, the attraction bias applied to the first and second surfaces of the sheet S, respectively, may be set to different values between the first surface of the sheet and the second surface. More specifically, the attraction bias is set lower when it is applied to the second surface of the sheet S being conveyed by the sheet conveyor belt 7 than when it is applied to the first surface of the sheet S being conveyed by the sheet conveyor belt 7 to thereby reduce the occurrence of creases more reliably. It should be noted that the attraction bias applied to the second surface of the sheet S should be at least the minimum value that is required to hold the sheet S on the sheet conveyor belt 7. Although in the above example, the fixed current power supply 13 is used to apply the attraction bias (current) to the attraction roller 12, alternatively a fixed voltage power supply may be used to apply an attraction voltage bias to the attraction roller 12. In this case, the attraction voltage bias applied to the first surface of the sheet is set to a larger voltage value than a value applied to the second surface.

Figure 9:
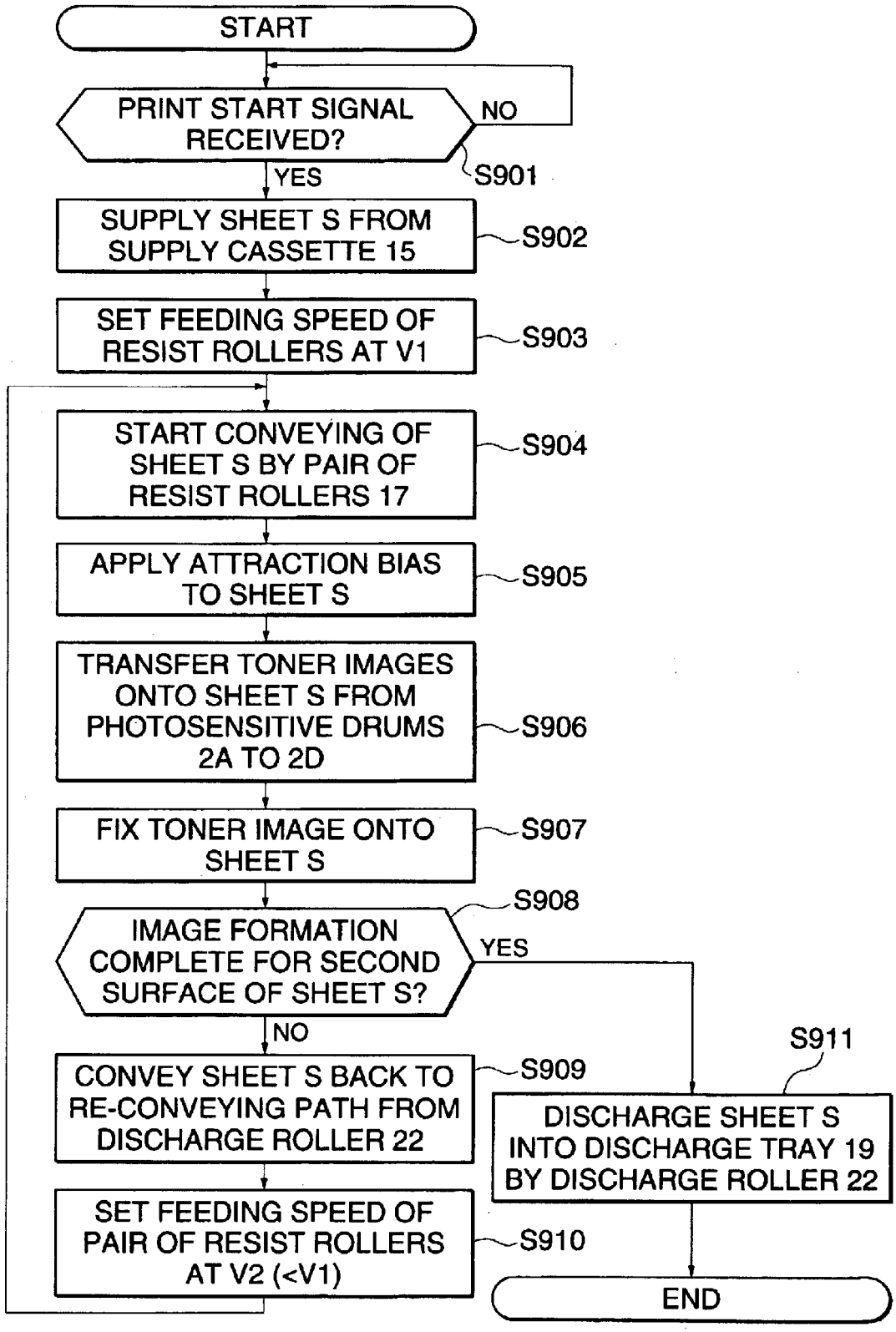
FIG. 9 is a flowchart showing the operation of forming images on both surfaces of the sheet.

The operation of forming images on both surfaces of the sheet S will be described below using the flowchart in FIG. 9.

Since the present operation forms images on both surfaces of the sheet S, it is assumed that an instruction for performing two-sided printing has been outputted from the host apparatus to the image forming apparatus.

In step S901, the image forming controller 23 determines whether a print start signal that is transmitted via the image processing controller 24 from the host apparatus, such as a host computer, has been received. When the print start signal has been received (YES in step S901), an initialization process is performed for all of the parts related to image formation, so that the current applied to the charging rollers 3*a* to 3*d*, the emission of the laser light by the exposers 4*a* to 4*d*, the developing biases applied to the developing sleeves 50*a* to 50*d*, etc., are initialized. The process then proceeds to step S902.

In step S902, the image forming controller 23 drives the feed motor M3 so as to rotate the supply roller 16 to supply a sheet S from the supply cassette 15.

In step S903, the image forming controller 23 sets a predetermined speed V1 as the feeding speed of the pair of resist rollers 17 for the first surface (the front) of the sheet S.

In step S904, the image forming controller 23 drives the feed motor M3 to guide the sheet S, which has been fed by the supply roller 16, towards the image forming stations 1*a* to 1*d*, so that the operation that the sheet S is fed by the pair of resist rollers 17 is started. It should be noted that the feeding speed of the pair of resist rollers 17 used when forming an image on the first surface of the sheet S is set at the predetermined value V1 that was set in step S903.

In step S905, when the sheet S passes the location where the attraction roller 12 and the follower roller 9 face one another moving towards the image forming station 1*a*, an attraction bias (a fixed current bias of 10 $\mu$A, for example) is applied to the sheet S by the fixed current power supply 13 via the attraction roller 12.

In step S906, toner images are successively transferred on top of one another onto the sheet S that is held onto the sheet conveyor belt 7 by attraction. In the present embodiment, toner images of four different colors are successively transferred, so that for example, at the image forming station 1*a* cyan toner is transferred from the photosensitive drum 2*a* to the sheet S and the sheet S is conveyed onwards, at the image forming station 1*b* yellow toner is transferred from the photosensitive drum 2*b* to the sheet S and the sheet S is conveyed onwards, at the image forming station 1*c* magenta toner is transferred from the photosensitive drum 2*c* to the sheet S and the sheet S is conveyed onwards, and at the image forming station 1*d* black toner is transferred from the photosensitive drum 2*b* to the sheet S and the sheet S is conveyed onwards, resulting in a color toner image being formed on the sheet S.

The size of the sheet S that is conveyed by the image forming apparatus is larger than the distance between the pair of resist rollers 17 and the image forming station 1*a*, so that after feeding by the pair of resist rollers 17 starts in step S904, the sheet S is conveyed by the photosensitive drum 2*a* before the trailing end of the sheet S passes the pair of resist rollers 17.

In step S907, heat and pressure are applied by the fixer 18 so as to fix the color toner image formed on the sheet S. It should be noted that the rollers that compose the fixer 18 are driven by the fixing motor M4 that is controlled by the image forming controller 23, so that the rollers rotate under such driving and convey the sheet S towards the discharge roller 22.

In step S908, the image forming controller 23 determines whether image formation has been completed on the second surface of the sheet S. When this is the case (YES in step S908), the process proceeds to step S911 where the discharge roller 22 is driven by the fixing motor M4 and the sheet S is discharged onto the discharge tray 19. When this is not the case (NO in step S908), image formation is to be performed on the second surface of the sheet S, and then the process proceeds to step S909.

In step S909, in order to reverse the sheet S and have the sheet S conveyed to the re-conveying path 20, after the trailing end of the sheet S has passed the fixer 18, the image forming controller 23 performs control to have the fixing motor M4 rotate in reverse. The sheet S that is conveyed to the re-conveying path 20 by the discharge roller 22 is conveyed back towards the pair of resist rollers 17 by the re-conveying rollers 21.

In step S910, before image formation is performed on the second surface (the reverse) of the sheet S, the image forming controller 23 sets the feeding speed of the pair of resist rollers 17 at a slower predetermined speed V2 (for example, 0.2% slower) than the predetermined value V1 that is set when forming an image on the first surface of the sheet S. After this, the process returns to step S904 and the same operation is performed as for the first surface, except that in step S904 the feeding speed of the pair of resist rollers 17 is set differently to the case of the first surface, so that when image formation is performed on the second surface of the sheet S, wrinkles in the sheet do not gather at the trailing end of the sheet S and are instead dispersed on the sheet conveyor belt 7. Creases are not formed, so that the creation of unprinted areas is prevented.

It should be noted that in the step S905 in which the attraction bias is applied to the second surface of the sheet S, the value of the attraction bias applied to the second surface is set to a smaller value, e.g. 5 $\mu$A, than the value applied to the first surface (10 $\mu$A). This is to reduce the attraction of the sheet S to the sheet conveyor belt 7 so as to prevent creases which can be formed in forming an image on the second surface from being formed.

Although in the present embodiment, control is always being performed of the feeding speed of the pair of resist rollers 17 when two-sided printing is being performed, in fact the phenomenon that that creases are formed and unprinted areas appear is especially common when thin paper, which is to say paper with a weight of 60 to 70 g/m$^2$ for example, is used as the sheet S. Therefore, a special operation mode may be provided for use when thin paper is used as the sheet S, and when this special operation mode is selected, the above-described control of the feeding speed of the pair of resist rollers 17 may be performed. The setting of the special operation mode may be made through an input by the operator using an operation panel provided on the image forming apparatus or may be made by the operator using the host apparatus with the image forming controller 23 receiving setting information via the image processing controller 24. More specifically, when the special operation mode is not set, the feeding speed of the pair of resist rollers 17 used when the pair of resist rollers 17 feed a sheet S that has been conveyed from the re-conveying path 20 is approximately the same as the speed used when a sheet S has been fed from the supply cassette 15. On the other hand, when the special operation mode is set, the feeding speed of the pair of resist rollers 17 used when the pair of resist rollers 17 feed a sheet S that has been conveyed from the re-conveying path 20 is set slower than the speed used when a sheet S has been fed from the supply cassette 15.

Figure 10:
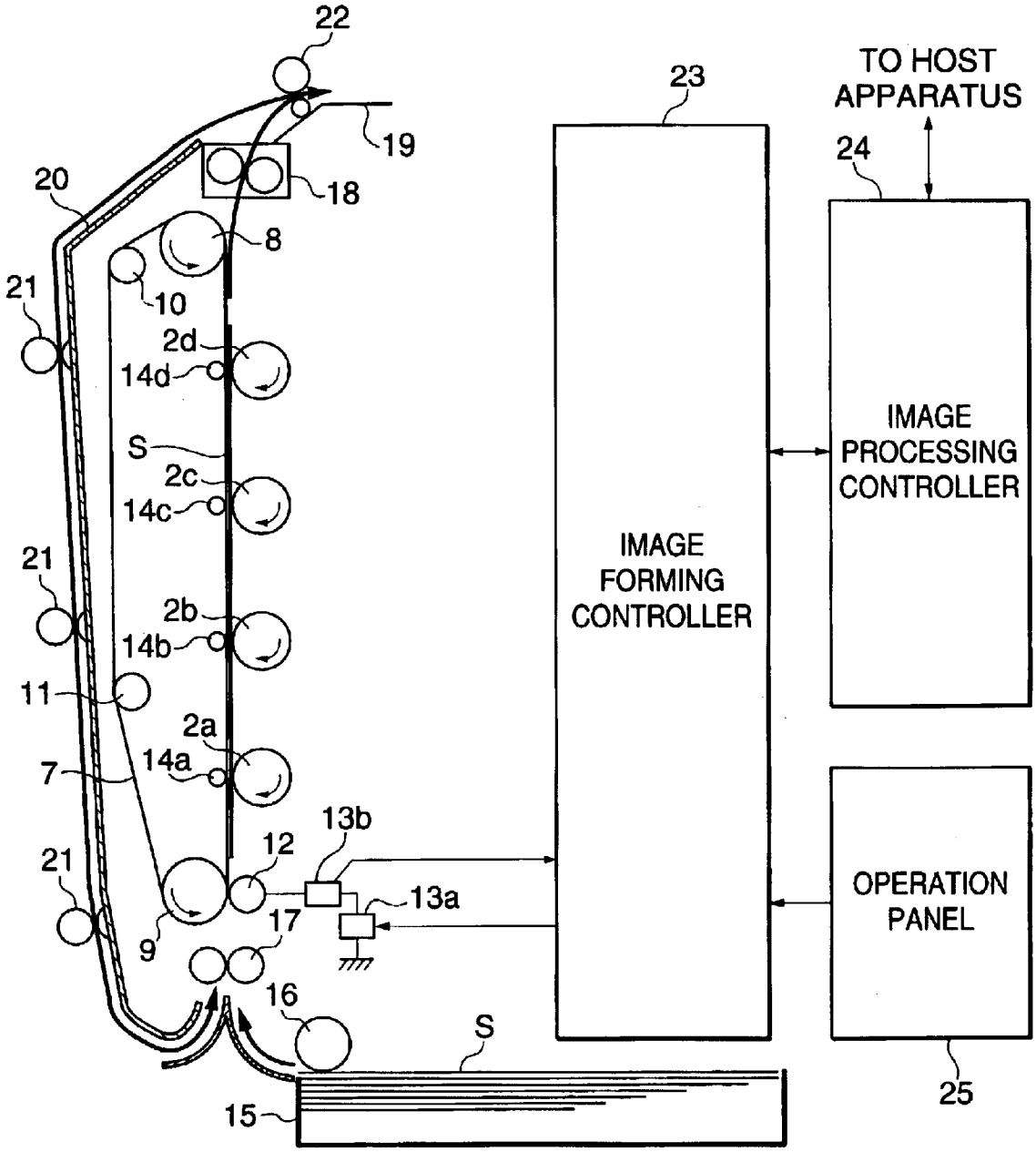
FIG. 10 is a diagram useful in explaining a method of detecting the resistance of the sheet.

Another example of the phenomenon that creases are formed and images with prominent unprinted areas are produced is a moist environment where the moisture content of the sheet S is high. The moisture content of the sheet S is correlated to the electrical resistance, so that when the moisture content is high, the electrical resistance of the sheet S will be low. Therefore, when image formation is performed on the first surface of the sheet S, for example, a voltage at a fixed current (or alternatively the current at a fixed voltage) applied to the attraction roller 12 may be detected, for example, the resistance of the sheet S may be calculated from the detected voltage (or the detected current), and the feeding speed of the pair of resist rollers 17 may be controlled as described above (i.e., the operation mode may be set) in accordance with the calculated resistance. The fixed current power supply 13 described using FIG. 1 is comprised, for example, of a voltage applying unit 13*a* and a current detecting unit 13*b* as shown in FIG. 10. A voltage set by the image forming controller 23 is applied by the voltage applying unit 13*a*. The current detecting unit 13*b* detects the current that flows at this time point and outputs the detected current to the image forming controller 23. Since the power supply 13 is a fixed current power supply, the image forming controller 23 determines a voltage to be set in the voltage applying unit 13*a* so that the current detected by the current detecting unit 13*b* becomes the fixed value (18 $\mu$A, for example). The voltage that is set so that a fixed current flows through the transfer medium fluctuates depending on the moisture content, etc., of the sheet S as described above, so that the resistance of the sheet S can be estimated from this set voltage.

When the resistance of the sheet S is no greater than a predetermined value ($10^7$ Ω, for example), or more specifically, when the voltage applied by the voltage applying unit 13*a* is no greater than a voltage applied when the resistance of the sheet S is the predetermined value, the feeding speed of the pair of resist rollers 17 for image formation performed on the second surface of the sheet S is set slower than the feeding speed used when image formation is performed on the first surface of the sheet S so that the phenomenon that creases are formed and unprinted areas appear can be prevented.

Also, instead of calculating the resistance of the sheet S, a humidity sensor (environment sensor) may be used to detect humidity and the feeding speed of the pair of resist rollers 17 (i.e., the setting of the operation mode) may be controlled as described above in accordance with the detected humidity. More specifically, when the humidity detected by the humidity sensor is at least equal to a predetermined value (70%, for example), the feeding speed of the pair of resist rollers 17 for image formation performed on the second surface of the sheet S is set slower than the feeding speed used when image formation is performed on the second surface of the sheet S so that the phenomenon that creases are formed and unprinted areas appear can be prevented.

The above-described control that changes the feeding speed of the pair of resist rollers 17 depending upon whether the humidity is high in the is also effective in low temperature-low humidity environments. That is, in a low temperature-low humidity environment where the moisture content of the sheet S is low, creases are not formed due to wrinkling in the sheet S and conversely the sheet is relatively stiff, so that setting the feeding speed of the pair of resist rollers 17 at a different speed to the conveying speed of the sheet conveyor belt 7 causes the sheet S to be significantly stretched, so that there is the risk of deformation in the toner images on the sheet S and an adverse effect on the color alignment.

In such a low temperature-low humidity environment, regardless of whether image formation is being performed on the first surface or the second surface of the sheet S, the feeding speed of the pair of resist rollers 17 is set approximately equal to the conveying speed of the sheet S by the sheet conveyor belt 7, so that color misalignment can be almost totally eradicated.

Although in the above described embodiment, the pair of resist rollers 17 can convey the sheet S together with the sheet conveyer 7 located opposite the attraction roller 12, the present invention may be applied to an image forming apparatus with no attraction roller 12. That is, the present invention may be applied to an arrangement in which the pair of resist rollers 17 can convey the sheet S together with the sheet conveyor belt 7 which is located opposite any one of the photosensitive drums 2*a* to 2*d* in the image forming stations 1*a* to 1*d*. The size of the sheet S that is conveyed by the image forming apparatus has only to be larger than the distance between the pair of resist rollers 17 and the image forming station 1*a*. The sheet S is conveyed while being held between at least the photosensitive drum 2*a* that is most upstream in the conveying direction and the sheet conveyor belt 7 and the pair of resist rollers 17, although which photosensitive drum is used to convey the sheet S while being held between the drum and the belt 7 depends upon the size of the sheet S.

As described above, according to the present invention in cases where a sheet that is to have image formation performed on a second surface (the reverse) thereof is fed from a re-conveying section, the sheet is fed at a second speed that is slower than when image formation was performed on a first surface of the sheet and is slower than the speed at which the image forming sections convey the sheet. As a result, when images are formed on both sides of the sheet, the formation of creases in the sheet can be suppressed, and the creation of unprinted areas can be almost totally prevented.

What is claimed is:

1. An image forming apparatus comprising:

a sheet stacking section in which sheets are stacked each having a first surface and a second surface;

a sheet conveying section that conveys the sheets;

an image forming section that forms an image on a sheet while the sheet is conveyed by said sheet conveying section;

a re-conveying section that again conveys the sheet having an image formed on the first surface thereof to said image forming section;

a sheet feeding section that feeds a sheet from one of said sheet stacking section and said re-conveying section to said sheet conveying section, wherein the sheet is conveyed while it is held between said sheet conveying section and said sheet feeding section; and a controller that controls a feeding speed of the sheet fed by said sheet feeding section, wherein said controller controls the feeding speed of the sheet in a manner such that the sheet is fed at a first speed when the sheet is fed from said sheet stacking section to form an image on the first surface of the sheet, and, the sheet is fed at a second speed lower than the first speed and lower than a speed at which the sheet is conveyed by said sheet conveying section when the sheet is fed from said re-conveying section to form an image on the second surface of the sheet.

2. An image forming apparatus according to claim 1, wherein the first speed is approximately equal to the speed at which the sheet is conveyed by said sheet conveying section.

3. An image forming apparatus according to claim 1, further comprising an operation mode setting section that sets an operation mode of the image forming apparatus, and wherein said controller is responsive to setting of a first operation mode by said operation mode setting section, for causing the sheet from said re-conveying section to be fed at the first speed, and is responsive to setting of a second operation mode by said operation mode setting section, for causing the sheet from said re-conveying section to be fed at the second speed.

4. An image forming apparatus according to claim 3, wherein said operation mode setting section sets the operation mode based on information relating to a type of the sheet.

5. An image forming apparatus according to claim 3, further comprising a detection section that detects a resistance of the sheet, wherein said operation mode setting section sets the first operation mode when the resistance of the sheet is higher than a predetermined value and sets the second operation mode when the resistance of the sheet is equal to or lower than the predetermined value.

6. An image forming apparatus according to claim 3, further comprising a detection section that detects humidity, and wherein said operation mode setting section sets the first operation mode when the humidity is equal to or lower than a predetermined value and sets the second operation mode when the humidity is higher than the predetermined value.

7. An image forming apparatus according to claim 1, wherein said image forming section comprises an image carrier that transfers a toner image onto the sheet and a fixing section that fixes the toner image onto the sheet.

8. An image forming apparatus according to claim 7, wherein said fixing section comprises a pair of rollers that rotate while they are in contact with one another and fixes the toner image onto the sheet by heating and applying pressure to the sheet.

9. An image forming apparatus according to claim 1, wherein said sheet conveying section comprises a belt-shaped conveying member that conveys the sheet, and the image forming apparatus comprises a bias applying section that applies a bias for holding the sheet on said belt-shaped conveying member by attraction.

10. An image forming apparatus according to claim 1, wherein said sheet conveying section comprises a belt-shaped conveying member that conveys the sheet, and said image forming section comprises a plurality of image carriers that are arranged in a conveying direction of the sheet, for forming toner images of different colors on the sheet that is conveyed by said belt-shaped conveying member.

11. An image forming apparatus according to claim 10, comprising a bias applying section for holding the sheet on said belt-shaped conveying member by attraction.

12. An image forming method of forming an image on both surfaces of a sheet, comprising:

a supplying step of supplying a sheet from a sheet stacking section in which sheets are stacked;

a first feeding step of feeding the sheet supplied in said supplying step at a first speed;

a first conveying step of conveying the sheet fed in said first feeding step, starting from before feeding of the sheet in said first feeding step is completed;

a first image forming step of forming an image on a first surface of the sheet while the sheet is conveyed by said first conveying step;

a re-conveying step of re-conveying the sheet having the image formed on the first surface in said first image forming step, in order for an image to be formed on a second surface of the sheet;

a second feeding step of feeding the sheet re-conveyed in said re-conveying step, at a second speed that is slower than the first speed and is slower than a speed at which the sheet is conveyed in said first conveying step;

a second conveying step of conveying the sheet fed in said second feeding step, starting from before feeding of the sheet in said second feeding step is completed; and a second image forming step of forming an image on the second surface of the sheet while the sheet is conveyed in said second conveying step.

13. An image forming method according to claim 12, wherein the first speed is approximately equal to a speed at which the sheet is conveyed in said first conveying step and said second conveying step.

14. An image forming method according to claim 12, wherein said first image forming step and said second image forming step each comprise a transfer step of transferring a toner image onto the sheet, and a fixing step of fixing the toner image on the sheet.

15. An image forming method according to claim 14, wherein said first image forming step and said second image forming step each include a plurality of said transfer steps of transferring toner images of different colors onto the sheet.

16. An image forming method according to claim 12, wherein said first image forming step includes a first bias applying step of applying a bias for holding the sheet on a belt-shaped conveying member by attraction in said first conveying step, and said second image forming step includes a second bias applying step of applying a bias for holding the sheet on the belt-shaped conveying member by attraction in said second conveying step.

* * * * *

UNITED STATES PATENT AND TRADEMARK OFFICE

CERTIFICATE OF CORRECTION

PATENT NO. : 6,836,641 B2
DATED : December 28, 2004
INVENTOR(S) : Michio Uchida et al.

It is certified that error appears in the above-identified patent and that said Letters Patent is hereby corrected as shown below:

Column 1,
Line 59, “part)(Sb)” should read -- part (Sb) --.

Column 4,
Line 6, “of appyling” should read -- of --.
Line 55, “has” should read -- having --.
Line 64, “sheet” should read -- sheet, --.

Column 7,
Line 1, “forwards” should read -- forward --.

Column 12,
Line 55, “phenomenon that” should read -- phenomenon --.

Signed and Sealed this

Seventeenth Day of May, 2005

JON W. DUDAS
*Director of the United States Patent and Trademark Office*